US005446516A

United States Patent [19]

Burbury et al.

[11] Patent Number: 5,446,516

[45] Date of Patent: Aug. 29, 1995

[54] REPLENISHER SYSTEM FOR X-RAY FILM PROCESSOR

[75] Inventors: Robert L. Burbury, Elgin; Warren G. Fischer, St. Charles, both, Ill.

[73] Assignee: Fischer Industries, Inc., Geneva, Ill.

[21] Appl. No.: 200,202

[22] Filed: Feb. 23, 1994

[51] Int. Cl.[6] ..... G03D 13/00

[52] U.S. Cl. ..... 354/298; 354/299; 354/324

[58] Field of Search ..... 354/298, 299, 319–324, 354/331, 336; 134/64 P, 64 R, 122 P, 122 R

[56] References Cited

U.S. PATENT DOCUMENTS

| | | | |
|---|---|---|---|
| 3,589,263 | 7/1968 | William | 354/299 |
| 3,650,196 | 3/6972 | Hosoe et al. | 354/324 |
| 3,662,660 | 5/1972 | Layne | 354/324 |
| 3,832,730 | 8/1974 | Geyken et al. | 354/299 |
| 3,852,793 | 12/1974 | McClintock | 354/324 |
| 3,872,827 | 3/1975 | Howe et al. | 118/223 |
| 3,876,116 | 4/1975 | Kushima et al. | 118/602 |
| 4,119,989 | 10/1978 | Carvalko et al. | 354/298 |
| 4,160,594 | 7/1979 | Geyken | 354/324 |
| 4,190,346 | 2/1980 | Hutson et al. | 354/324 |
| 4,293,211 | 10/1981 | Kaufman | 354/298 |
| 4,402,590 | 9/1983 | Rubin | 354/324 |
| 4,421,399 | 12/1983 | Steube | 354/299 |
| 4,428,777 | 1/1984 | Muller | 134/64 P |
| 4,505,565 | 3/1985 | Tanaka | 354/299 |
| 4,577,950 | 3/1986 | Mackson | 354/324 |
| 4,650,308 | 3/1987 | Burbury | 378/101 |
| 4,679,218 | 7/1987 | Brunn | 354/299 |
| 4,952,958 | 8/1990 | Ohba et al. | 354/322 |
| 5,196,878 | 3/1993 | Muller | 354/299 |
| 5,319,410 | 6/1994 | Glover et al. | 354/324 |

FOREIGN PATENT DOCUMENTS

| | | |
|---|---|---|
| 1539623 | of 0000 | United Kingdom . |
| WO87/03973 | 7/1987 | WIPO . |

*Primary Examiner*—D. Rutledge

*Attorney, Agent, or Firm*—Polster, Lieder, Woodruff & Lucchesi

[57] ABSTRACT

A combined, temperature-controlled chemical recirculation and replenishment system including a first conduit defining a recirculation loop conducted between the drain and the inlet of a reactant tank. A pump recirculates reactant chemical through the first conduit, and a controllable heater is connected to the first conduit for heating the reactant chemical. The heat sensor is connected to the heater for sensing the temperature and outputting the temperature signal to a controller. A second conduit is connected between a replenishment tank and the pump. A controllable valve is connected in the second conduit. A controller is connected both to the heater and to the controllable valve. The controller receives the temperature signal from the sensor and is responsive to that temperature signal to activate the heater to maintain the reactant at the optimum temperature. The controller is also responsive to the temperature signal for opening the controllable valve when the reactant is at the optimum temperature, thereby allowing replenishment reactant to flow through the second conduit and to enter the recirculation loop via the pump.

10 Claims, 4 Drawing Sheets

REPLENISHER SYSTEM FOR X-RAY FILM PROCESSOR

FIELD OF THE INVENTION

This invention relates generally to film processing, and a more particularly to a developer replenishment and recirculation system for development of x-ray film.

BACKGROUND OF THE INVENTION

A variety of automatic film processors are available which are capable of developing films exposed to various forms of energy. The exposure of the film to that energy creates a latent image on the film. In order to render that image visible, the film is passed through a developer solution. In the automatic film processors referred to above, development takes place in a developer tank. During processing, the film passes through the developer tank where the latent image becomes visible. The film is then passed through a tank holding fixer solution which hardens and preserves the visible image. The film is then washed and dried by the processor so that it is available for analysis. An example of such a system is shown in U.S. Pat. No. 4,650,808 to Burbury which is incorporated into an automatically self-cleaning processor.

The crucial step in this automatic film processing is the development step. Several variables can affect the quality of development. Included among these are the temperature of the developer solution, and the amount of active developer solution that reaches the film. In order to continually provide the film surface with active developer solution, it is desirable to continually agitate the solution. In prior art systems, both agitation and temperature control of the developer are achieved by means of a developer recirculation system. A typical recirculation system is shown in FIG. 1. The recirculation system RS is connected between the drain D and inlet I of the developer tank T. Developer is recirculated through the system by means of pump P. Developer solution drawn out of tank T though drain D is pumped by pump P through a heater H and back into the tank through inlet I. A heat sensor S is connected to heater H. The thermostat TH receives a temperature signal from the sensor S, and selectively activates and deactivates the heater H to maintain the developer solution at an optimum temperature, illustratively 93° F. While maintaining the proper temperature for the developer, the recirculation RS system also agitates the developer. Even with such agitation, however, a given quantity of developer solution has a limited effective lifetime, and the developer solution must be either changed or replenished periodically.

Other prior art systems are available which include an automatic replenishment system for the developer solution. Typically, such a system includes a replenishment tank and a separate pump for pumping replenishment solution to the developer tank. The replenishment system is used in conjunction with the recirculation system described above. Such a system is shown in FIG. 2. The replenishment pump $P_2$ pulls replenishment developer out of the replenishment tank RT, and adds it to the developer tank at inlet $I_2$, causing the level of developer in the developer tank to rise. The developer tank includes an overflow outlet O, from which the overflow may be returned to the replenishment tank RT. At the same time, the operation of the recirculation system progresses as described above as driven by pump $P_1$. In effect, then, the recirculation system is expanded to include the contents of the replenishment tank. These systems are generally referred to as closed-loop systems. Since replenishment tanks may have a volume greater than that of the developer tank, closed-loop systems can effectively more than double the developer available to the automatic processor. The increased volume of developer thus has a longer effective lifetime, since that larger quantity of developer becomes contaminated more slowly than in the previously-described system.

While such systems do prolong the lifetime of the developer solution by slowing contamination, they are not without significant drawbacks. Since both the contents of the developer tank and the contents of the replenishment tank are continually used for development, that entire volume must be heated to the optimum temperature. As a result, the heater must heat not only the developer being recirculated to the developer tank, but also the entire contents of the replenishment tank, which may be significant illustratively being on the order of 5 gallons. This means that a higher-power heater must be used as compared to systems wherein the heater just heats the recirculating developer. Furthermore, the warm-up time of such an automatic film processor is significant. Long warm-up times can be a serious drawback in such system, particularly in environments where the processor is only used periodically. In such environments, the processors typically go into a standby mode between processing cycles. In the standby mode, the recirculation pump is not pumping, and the heater is not activated. Thus, when the processor comes out of standby mode, the developer must be re-heated before a developing cycle can occur. When the processor is only used periodically, it is inconvenient and time-consuming to wait for re-heating of the increased volume of developer before each cycle. In systems where the processor is being used continually, this long warm-up time occurs only when the processor is first turned on. However, the higher-power heater consumes large amounts of electricity in maintaining the increased developer volume at the optimum temperature. The temperature control in such system is also imprecise. Since the replenishment tank has such a large volume, some of the developer solution remains in the tank for significant periods of time before being recirculated to the developer tank. During this time, this developer may cool. As a result, cool developer solution is added to the recirculation system, thus potentially creating large temperature fluctuations in the developer which adversely affect the quality of development.

In other prior art systems, the overflow from the developer tank is applied to an external drain as opposed to being returned to the replenishment tank. Such a configuration is shown in phantom in FIG. 2. In this arrangement, the contents of the recirculation tank RT are not effectively added to the recirculation system. Rather, the cold developer from RT is periodically added to the developer tank and the tank overflow goes to the external drain. The addition of replenishment developer to the developer tank typically only occurs when film is in the processor, as continual replenishment would result in undue waste. Since only the contents of the recirculation system is being heated in this configuration, initial warm-up times are lower than in closed-loop systems. However, cold developer is periodically added directly to the developer tank during development. This adversely affects the temperature of the developer solution and thus development quality.

SUMMARY OF THE INVENTION

Accordingly, it is the primary object of the present invention to provide an improved recirculation and replenishment system for a reactant chemical, particularly film developer, which must be introduced into a reaction tank at an optimum temperature and concentration.

An important further object of the invention is to reduce the warm-up time required for bringing the developer to the optimum temperature.

A related object is to provide a more energy efficient means for maintaining the developer solution at the optimum temperature.

A further object is to provide a developer recirculation system wherein the temperature of the developer is more accurately controlled.

A still further object is to provide a developer recirculation and replenishment system that extends the lifetime of the developer solution.

It is a feature of the present invention that a single pump is used in a combined recirculation and replenishment system.

It is a related feature that the combined recirculation and replenishment system provides for replenishment based on the temperature of the recirculating developer solution.

The above objects, and others, are realized in accordance with this invention by providing a combined, temperature-controlled chemical recirculation and replenishment system comprising a single pump and which includes a controllable valve between a replenishment tank and a recirculation loop which is controlled to only allow replenishment developer to enter the recirculation loop when the quantity of developer in the loop and the tank is at the optimum operating temperature. The chemical recirculation and replenishment system includes a first conduit defining a recirculation loop connected between the drain and the inlet. A pump is included for recirculating the reactant chemical through the conduit from the drain of the reaction tank to its inlet. A controllable heater is connected in the first conduit between the pump and the tank inlet for heating the reactant chemical. The heater includes a heat sensor for sensing the temperature of the reactant chemical and outputting a temperature signal. An external replenishment tank is provided to maintain a supply of replenishing reactant. A second conduit is connected between the replenishment tank and the pump. A controllable valve is connected in the second conduit between this replenishment tank and the inlet to the pump. A controller is also included which is connected to the heater and to the controllable valve. The controller receives the temperature signal from the sensor and is responsive to that temperature signal to selectively activate the heater to maintain the reactant at the optimum temperature. The controller is also responsive to the temperature signal for opening the valve when the reactant is at the optimum temperature, thereby allowing replenishing reactant to flow out of the replenishment tank through the second conduit and to enter the recirculation loop via the pump. In one embodiment, any overflow developer generated by adding replenishment reactant is returned to the replenishment tank. In an alternative embodiment, that overflow is drained out of the system. This alternative embodiment has the advantage of only allowing fresh replenishment solution to enter the recirculating system. According to either embodiment, warm-up time is reduced, and temperature control of the reactant is increased by the control of the controllable valve which forms a significant aspect of the present invention.

The invention also includes a method for maintaining the temperature and concentration of the chemical reactant in a reactant tank. The steps of that method include pumping reactant chemical through a recirculating loop including a heater. The temperature of the reactant is monitored in the loop, and the heater is selectively activated to maintain a reactant at the optimum temperature. A controllable valve is opened to allow fresh chemical reactant to enter the recirculating loop only when the chemical reactant is at the optimum temperature.

DETAILED DESCRIPTION OF THE PREFERRED EMBODIMENTS

While the invention will be described and disclosed in connection with certain preferred embodiments and procedures, it is not intended to limit the invention. Rather, the invention covers all such alternative embodiments and modifications as fall within the spirit and scope of the appended claims. For example, the embodiments disclosed in this detailed description will relate primarily to a combined recirculation and replenishment system used an automatic film developing apparatus. The apparatus and method of the invention however, are generally applicable to all systems wherein a quantity of a reactant chemical must be introduced into a reaction chamber at a specified, controllable temperature and concentration.

Figure 1:
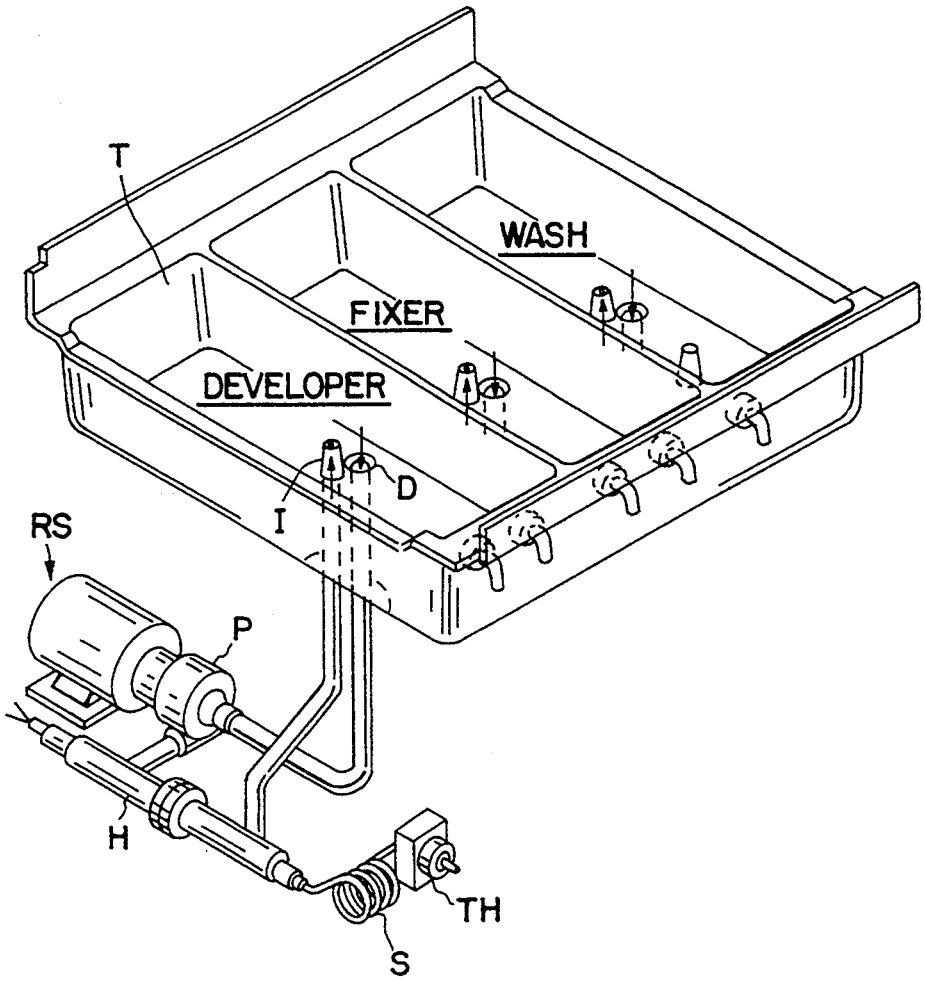
FIG. 1 PRIOR ART
FIG. 1 is a perspective representation of a typical recirculation system for a developer tank.
Figure 2:
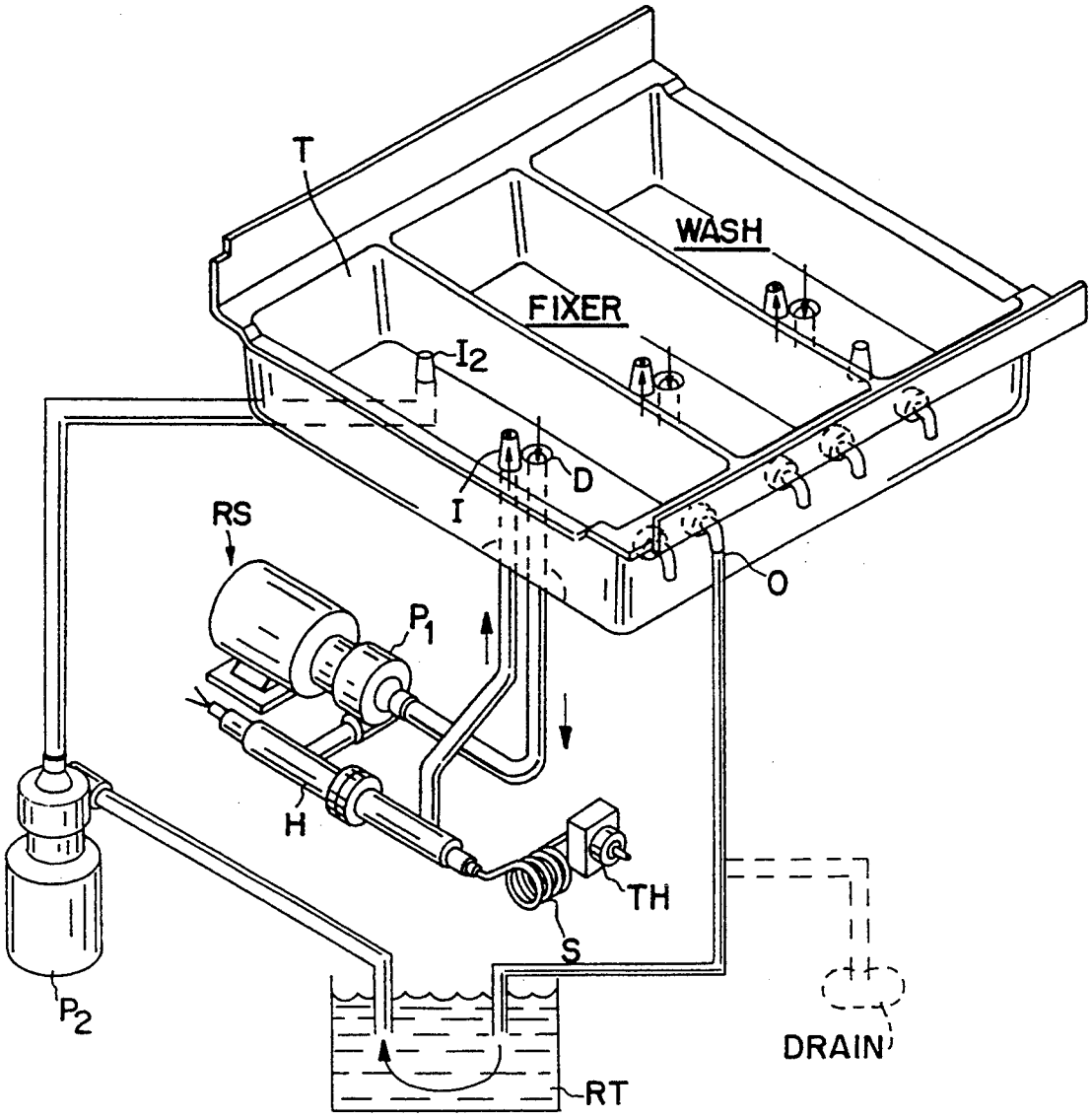
FIG.2 PRIOR ART
FIG. 2 is a perspective representation of a typical recirculation system and replenisher system for a developer tank.
Figure 3:
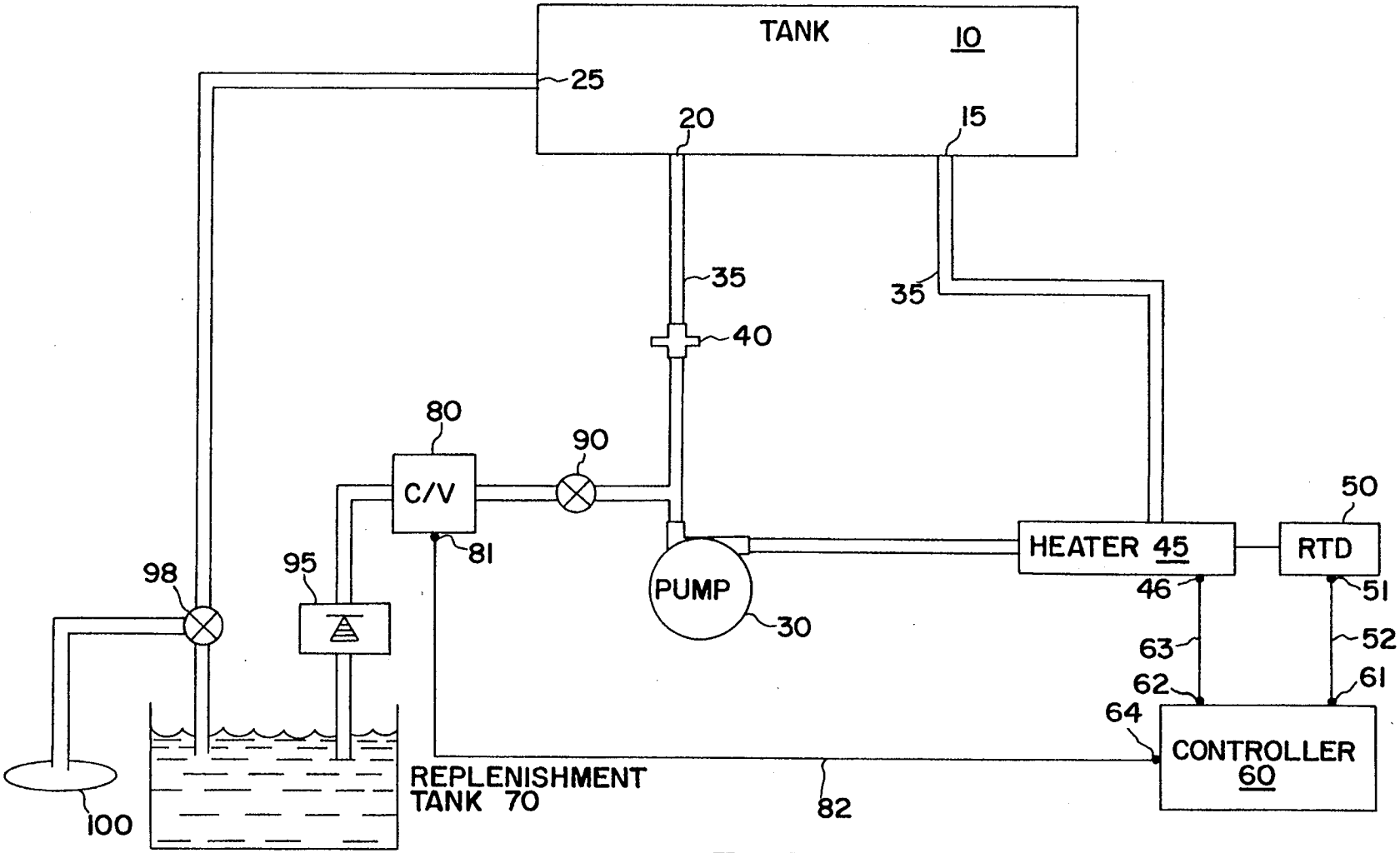
FIG. 3 is a block diagram of the combined, temperature-controlled chemical recirculation and replenishment system according to one embodiment of the present invention.

A recirculation/replenishment system, according to the present invention, is depicted in the block diagram of FIG. 3. A reaction chamber 10 is adapted to receive a reactant chemical at an inlet 15. For the purposes of this description, but without intent to be limiting, the reaction chamber 10 may be the development tank of an automatic film developer solution. Further, the reactant chemical may be developer solution. Whatever the specific application for which the present invention is used, the reaction chamber 10 is of the type requiring a reactant chemical at a controlled temperature and concentration. For the remainder of this description, the reaction chamber will be referred to as the developer tank 10 and the reactant chemical will be referred to as developer solution.

For controlling the entrance and exit of developer solution in tank 10, it includes an inlet 15, a drain 20, and an overflow outlet 25. As will be discussed in detail below, developer solution is recirculated to tank 10 by virtue of being pumped through a recirculation loop from drain 20 to inlet 15. Under certain predetermined conditions, replenishment developer solution is added to the tank 10. This may cause the level of developer in tank 10 to rise above the level of the overflow outlet 25. This creates an overflow, ensuring that the level of developer solution remains below a maximum value.

To recirculate developer solution from drain 20 to inlet 15 of tank 10, a pump 30 is provided. A first conduit 35 is connected between the drain 20 and the inlet 15. Various components, according to the invention are connected in series in this conduit 35, which defines a recirculation loop for the developer solution. Developer solution leaves tank 10 through drain 20 and flows to pump 30. A restricter 32 may be included in the first conduit 35 to create a negative pressure upstream of pump 30. The recirculating developer is further pumped through a heater 45, the operational details of which are discussed below, and through the remainder of conduit 35 back to the inlet 15. One purpose of this recirculation of the developer solution is to agitate the developer to ensure that active developer is continually provided to the film surface. The other purpose of recirculation is to maintain the temperature of the developer at its optimum operating level.

To regulate the temperature of the developer solution; and to maintain it at the optimum operating level, a controllable heater 45 is included in the recirculation loop between inlet 15 and drain 20. Developer solution flowing out of pump 30 is pumped though heater 45 before being returned to the tank 10 via conduit 35. The heater is controlled to maintain the developer solution at the optimum temperature. This control is achieved by means of a temperature sensor 50 working in combination with a thermostat 60. The temperature sensor 50, illustratively a resistive temperature device or thermistor, monitors the temperature of the developer solution in the heater and outputs a signal representative of that temperature. The temperature signal is provided to the thermostat 60 which is responsive to that temperature signal for controlling the heater. If the desired temperature of the developer solution is either at or above the illustrative optimum temperature of 93° F., the thermostat would shut off the heater in order to allow the temperature to drop. Alternatively, if the temperature of the developer in the heater is below 93° F., the thermostat either turns on the heater or increases the heat output of the heater in order to increase the temperature of the developer solution. The temperature sensor 50 and thermostat 60 thus serve as a feedback loop to the heater ensuring that the temperature of the developer solution is maintained at the optimum operating temperature.

The pump 30 is used not only to recirculate developer solution in this manner, but is also used to selectively draw replenishment solution into the system. Unlike the closed-loop systems previously described, where addition of replenishment solution to the system was continuous, the present invention only allows replenishment solution to be added to the system in a controlled manner. This is also distinct from the prior art system where overflow resulting from separately pumped replenishment solution was returned to a drain. There, cold developer was added to the tank whenever film was present. Here, replenishment developer is only added not directly to the tank, but to the upstream side of the heater in the recirculation loop, and then only when the developer in that loop is at the optimum operating temperature.

To achieve this, a second conduit 60 is connected between a replenishment tank 70 and the inlet to the pump 30. A controllable valve 80 is connected in the second conduit between the replenishment tank 70 and the pump 30. The opening and closing of the valve 80 is controlled by the thermostat 60 which may also be referred to generally as a controller. According to a significant aspect of the invention, the thermostat 60 only allows valve 80 to open when the temperature of the developer solution, as measured by temperature sensor 50, is at the optimum operating temperature. When the developer solution in the heater 45 is not at the optimum temperature, the valve 80 is closed by the thermostat 60 thereby preventing addition of replenishment solution to the system.

The control valve 80 is of the normally-open type, and includes a control input for receiving an electrical signal from the thermostat 60. When the developer in the heater 45 is at the optimum temperature, no electrical signal is provided from thermostat 60 to valve 80, and it remains open. This allows replenishment solution to flow from the replenishment tank 70 into the pump 30, where the replenishment solution is added to the developer already in the system. Addition of developer from the replenishment tank 70 may begin to lower the temperature of the developer within the system. If this occurs, and the temperature falls below the optimum value, as measured by sensor 50, the thermostat immediately sends a signal to valve 80, closing the valve. As the heater warms the recirculating developer solution back to the optimum temperature the thermostat respondingly re-opens valve 80 by switching off the control signal. This process repeats itself indefinitely as the developer solution is being recirculated by pump 30.

Since valve 80 is only open when the temperature of the developer solution is at its optimum value the temperature of the developer solution is very accurately controlled. The temperature will not be allowed to rise above the optimum temperature by virtue of the fact that the thermostat 60 shuts off heater 45 in that event. Similarly the temperature will not be allowed to drop significantly below the optimum temperature, since, when this occurs, valve 80 is closed, ensuring the developer solution then within the recirculation loop will be maintained at that temperature, or will increase in temperature as the heater warms that solution. Moreover, valve 80 is closed during the warm-up process, by virtue of the fact that the temperature in the recirculation loop is below the optimum. This ensures a short warm-up time since only the solution in the recirculation loop is warmed.

The opening of valve 80 will necessarily increase the volume of developer in the developer tank and the recirculation loop. As the level of developer in the tank 10 increases, the excess developer will spill out of overflow outlet 25. This overflow may be returned to the replenishment tank 70. If this occurs, the contents of the replenishment tank 70 are slowly contaminated along with the remainder of the development solution in the system although this occurs more slowly than in prior art systems wherein the replenishment solution is continually recirculated. As an alternative, however, the overflow outlet 25 may be returned to an external drain 100. For switching the overflow between drain 100 and tank 70, a switch valve 98 is provided. This may be preferable in order to ensure that the developer solution in the replenishment tank remains fresh until it is added to the system by flow through valve 80. Return of this overflow to an external drain is not overly wasteful, since replenishment solution is only added to the system, according to the invention, under specified conditions i.e. when the developer solution in the tank and recirculation loop is at the optimum temperature. Because of the accuracy of the temperature control of the developer solution, only small increments of replenisher developer will be added during a given interval to the recirculation loop, meaning that an overflow during that same interval will be minimal. Thus, the temperature and concentration of the developer solution can be carefully controlled without contaminating the replenisher developer held in the replenisher tank.

The second conduit between replenishment tank 70 and pump 30 includes other components which add flexibility to the system. A flow control valve 90 can be adjusted to increase or decrease the rate of flow of replenishment developer to the second conduit into the recirculation loop during the times when the valve 80 is opened. To prevent back flow of replenishment solution during the times when control valve 80 is open, a check valve 95 is placed in the second conduit between the control valve 80 and the replenishment tank 70. This prevents backflow and draining of tank 10 when the system is turned off.

Figure 4:
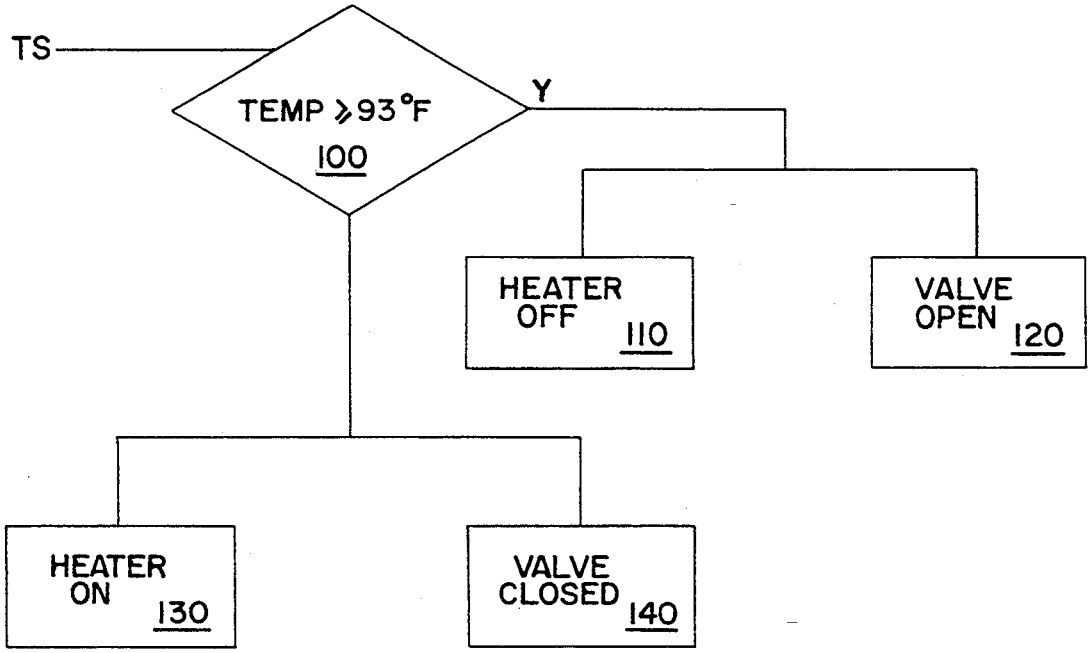
FIG. 4. Is a flow-chart of a temperature-controlled replenishment/recirculation method according to one embodiment of the invention.

Although the description of the apparatus according to the invention above implicitly discussed the method whereby the temperature and concentration of the developer solution are maintained the developer tank, the steps comprising that method will not be explicitly reviewed. Reference is made to FIG. 4, which shows a simplified flow chart of that part of the inventive method performed by the thermostat 60, heater 45, temperature sensor 50 and control valve 80. According to the method, the developer is pumped through recirculating loop including a heater. The temperature of the developer solution is monitored. Based on that temperature monitoring, the heater is selectively activate to maintain the reactant at the optimum operating temperature. Further, a valve is opened allowing fresh developer to enter the recirculating loop from a replenishment tank when the developer solution is at the optimum temperature. The last two steps of the method just disclosed are represented in the flow chart of FIG. 4. A temperature signal is input into the thermostat as represented by input of a signal TS into decision block 100. The thermostat then determines whether the temperature is greater than or equal to 93° F. If the temperature is in that range, the thermostat outputs control signals to turn the heater off (110) and to open the valve (120) as represented by the "no" branch of the decision block 100. It will be noted that, according to the embodiment referred to above, the control signal to open the valve is a signal level of 0, since the valve is of the normally-open variety. If the thermostat determines that the temperature of the developer solution is not above or equal to 93° F., the heater is turned on, (130) in order to warm the solution and the valve is closed (140) to prevent further replenishment solution from entering the recirculating loop as represented by the "yes" branch of decision block 100. In this manner, the temperature of the developer solution is accurately maintained, while the concentration of that same solution is maintained, but only when addition of replenishment solution is allowed based on the temperature of the developer in the recirculation loop.

Thus, an apparatus and method for maintaining developer solution or any other reactant chemical, at an optimum temperature while providing for controlled replenishment of the solution is provided. The system is easy to implement, and has advantages in that warm-up times of the developer solution are lower, the power requirements of the heater are reduced as compared to conventional systems. Further, the temperature of the developer solution is more accurately maintained. Additionally, the recirculation pump is used effectively to also pump replenishment solution, unlike prior art systems where separate pumps are used.

I claim:

1. A combined, temperature-controlled chemical recirculation and replenishment system for use with a reaction tank requiring a quantity of a reactant chemical at an optimum temperature, the reaction tank including an inlet, a drain, and an overflow outlet, the system comprising in combination:

a first conduit connected between the drain and the inlet, and defining a recirculation loop;

a pump connected to the first conduit for recirculating the reactant chemical through the first conduit from the drain to the inlet;

a controllable heater connected in said first conduit between the pump and the inlet for heating the reactant chemical, the heater including a heat sensor for sensing the temperature of the reactant chemical and generating a temperature signal;

a replenishment tank for maintaining a supply of replenishing reactant;

a second conduit connected between the replenishment tank and the pump;

a controllable valve connected in the second conduit between the replenishment tank and the pump;

a controller connected to the heater and the controllable valve and including an input for receiving the temperature signal from the sensor, the controller being responsive to the temperature signal to selectively activate the heater to maintain the reactant at the optimum temperature, the controller being further responsive to the temperature signal for opening the valve when the reactant is at the optimum temperature, thereby allowing replenishing reactant to flow out of the replenishment tank through the second conduit and to enter the recirculation loop via the pump; and including a flow control valve disposed between the controllable valve and the pump.

2. The chemical recirculation and replenishment system according to claim 1, wherein the reaction tank overflow is returned to the replenishment tank.

3. The chemical recirculation and replenishment system according to claim 1, wherein the reaction tank overflow is returned to an external drain.

4. The chemical recirculation and replenishment system according to claim 1, wherein the controllable valve is normally open, and the controller closes the valve when the reactant is not at the optimum temperature.

5. The chemical recirculation and replenishment system according to claim 1, wherein the reactant chemical is developer solution for a photographic emulsion.

6. A combined, temperature-controlled chemical recirculation and replenishment system for use with a reaction tank requiring a quantity of a reactant chemical at an optimum temperature, the reaction tank including an inlet, a drain, and an overflow outlet, the system comprising in combination;

a first conduit connected between the drain and the inlet, and defining a recirculation loop;

a pump connected to the first conduit for recirculating the reactant chemical through the first conduit from the drain to the inlet;

a controllable heater connected in said first conduit between the pump and the inlet for heating the reactant chemical, the heater including a heat sensor for sensing the temperature of the reactant chemical and generating a temperature signal;

a replenishment tank for maintaining a supply of replenishing reactant;

a second conduit connected between the replenishment tank and the pump;

a controllable valve connected in the second conduit between the replenishment tank and the pump;

a controller connected to the heater and the controllable valve and including an input for receiving the temperature signal from the sensor, the controller being responsive to the temperature signal to selectively activate the heater to maintain the reactant at the optimum temperature, the controller being further responsive to the temperature signal for opening the valve when the reactant is at the optimum temperature, thereby allowing replenishing reactant to flow out of the replenishment tank through the second conduit and to enter the recirculation loop via the pump; and including a check valve disposed between the replenishment tank and the controller valve for preventing backflow into the replenishment tank when the controllable valve is open.

7. The chemical recirculation and replenishment system according to claim 6, wherein the reaction tank overflow is returned to the replenishment tank.

8. The chemical recirculation and replenishment system according to claim 6, wherein the reaction tank overflow is returned to an external drain.

9. The chemical recirculation and replenishment system according to claim 6, wherein the controllable valve is normally open, and the controller closes the valve when the reactant is not at the optimum temperature.

10. The chemical recirculation and replenishment system according to claim 6, wherein the reactant chemical is developer solution for a photographic emulsion.

* * * * *